US006409169B1

(12) United States Patent
Sutter

(10) Patent No.: US 6,409,169 B1
(45) Date of Patent: Jun. 25, 2002

(54) TABLE HOCKEY APPARATUS

(76) Inventor: Josef Beat Sutter, Gerbistrasse 10, CH-8730 Uznach (CH)

( * ) Notice: Subject to any disclaimer, the term of this patent is extended or adjusted under 35 U.S.C. 154(b) by 0 days.

(21) Appl. No.: 09/423,088

(22) PCT Filed: Apr. 28, 1998

(86) PCT No.: PCT/IB98/00648

§ 371 (c)(1),
(2), (4) Date: Apr. 10, 2000

(87) PCT Pub. No.: WO98/27801

PCT Pub. Date: Jul. 2, 1998

(30) Foreign Application Priority Data

May 2, 1997 (CH) ..... 1035/97

(51) Int. Cl.[7] ..... A63F 7/06
(52) U.S. Cl. ..... 273/108.1; 273/126 R
(58) Field of Search ..... 273/126 R, 126 A, 273/108, 108.1, 122 R; 463/3

(56) References Cited

U.S. PATENT DOCUMENTS 3,228,688 A * 1/1966 Dennison ..... 273/108.1 X
4,480,833 A 11/1984 Barcelow
4,691,920 A * 9/1987 Murphy et al. ..... 463/3
5,161,801 A 11/1992 Kazuk
5,931,465 A * 8/1999 Miyake et al. ..... 273/108.1

FOREIGN PATENT DOCUMENTS

| | | |
|---|---|---|
| DE | 1603093 | 1/1970 |
| DE | 2216750 | 4/1972 |
| DE | 2533094 | 2/1977 |
| DE | 4429620 | 5/1995 |
| FR | 634601 | 2/1928 |
| FR | 1053136 | 2/1954 |

* cited by examiner

*Primary Examiner*—Raleigh W. Chiu
(74) *Attorney, Agent, or Firm*—Browdy and Neimark, P.L.L.C.

(57) ABSTRACT

A table hockey game device (10) with a rectangular playing field (30). After a goal has been scored, a puck (1) reaches a puck transfer device (60), comprising a channel system (62) and a puck elevator (64), through a puck passage (46) in the area of the goal installation (44), by means of which the puck (1) is conveyed to a puck insertion opening (48). The table hockey game device contains only mechanical, mechanically controlled and manually actuable devices, and/or the playing field (30) and the puck transfer device (60) form a path, closed in itself, for the puck (1), which is located outside of the rectangular playing field (30).

22 Claims, 5 Drawing Sheets

TABLE HOCKEY APPARATUS

CROSS REFERENCE TO RELATED APPLICATION

The present application is the national stage under 35 U.S.C. 371 of PCT/IB98/00648, filed Apr. 28, 1998.

BACKGROUND OF THE INVENTION

1. Technical Field of the Invention

The invention relates to a table hockey game device having a puck transfer device, by means of which a puck can be brought through a puck insertion opening from puck passages arranged in the area of goal installations on a playing field.

2. Prior Art

Table game devices in the form of table soccer and table hockey game devices are known in various embodiments. They are used in private homes as well as in public places. Over time, the game devices have been developed into more and more technically perfect and therefore more and more expensive objects. Formerly a defined number of balls or pucks was provided after the insertion of a coin, which gradually disappeared after goals had been scored, and the game could be played as long as balls or pucks were available. With newer models the time, during which the table game device can be played by inserting a certain coin, is being limited. The table game device contains only one ball or puck, which is placed on the playing field following the insertion of the coin and which, after each goal has been scored, is returned to the playing field by a ball, or respectively puck, transfer device located in the area of the goal installations, from a ball, or respectively puck, transfer device located in the area of the goal installations, through which the ball or puck leaves the playing field, and is again available for play until the preset game time is up and the ball, or respectively puck transfer device is blocked in some way, after which the ball, or respectively puck, gets back to the playing field only after the insertion of a further coin.

When used in public places in particular, table game devices of this type are subjected to great wear and much damage, part of which is caused by carelessness and part by maliciousness. For example, cigarettes, bits of food, small pieces of wrapping materials and emptied drinks get on the playing field and from there into the puck transfer device. With table hockey game devices in particular it is important that the playing field be clean and undamaged, since the puck does not roll like a ball, but slides. Although a table hockey game device is known, wherein the playing field is covered by a transparent plate, the ball, or respectively puck, transfer device is located in the playing field itself. So that the ball or puck does not escape through the opening in the course of the game, it should be closed every time the ball or puck is supplied, which would require a separate device. This device furthermore has the disadvantage that, because of the separate puck transfer device, the playing field is almost square and does not form a rectangle with a ratio of approximately 1:2 of the sides, such as a real playing field.

OBJECT AND SUMMARY OF THE INVENTION

It is therefore the object of the invention to create a table hockey game device of the type mentioned at the outset, which avoids the mentioned disadvantages.

In accordance with the invention, in a first embodiment the novel table hockey game device therefore exclusively contains mechanical devices and the entire manipulation is manual. Thus, no electric power connection is required, so that the table hockey game device can be put up at any arbitrary location. This novel table hockey game device is simple and cost-effective to manufacture, rugged and little prone to malfunctions and without problems in maintaining it.

In a second embodiment, the table hockey game device is embodied in accordance with the invention in such a way that the entire path of the puck is closed in itself, wherein the puck transfer device and the puck insertion device are located outside of the playing field and the latter still forms a rectangle with a ratio of the sides which approximately corresponds to the ratio of the sides of regular hockey playing fields.

A third embodiment of the table hockey device of the invention having the characterizing features of both the first and the second embodiment is particularly advantageous.

BRIEF DESCRIPTION OF THE DRAWINGS

Further properties and advantages of the invention will be explained in what follows by means of preferred exemplary embodiments, making reference to the drawings. Shown therein are in.

DETAILED DESCRIPTION OF THE PREFERRED EMBODIMENTS OF THE INVENTION

Figure 1:
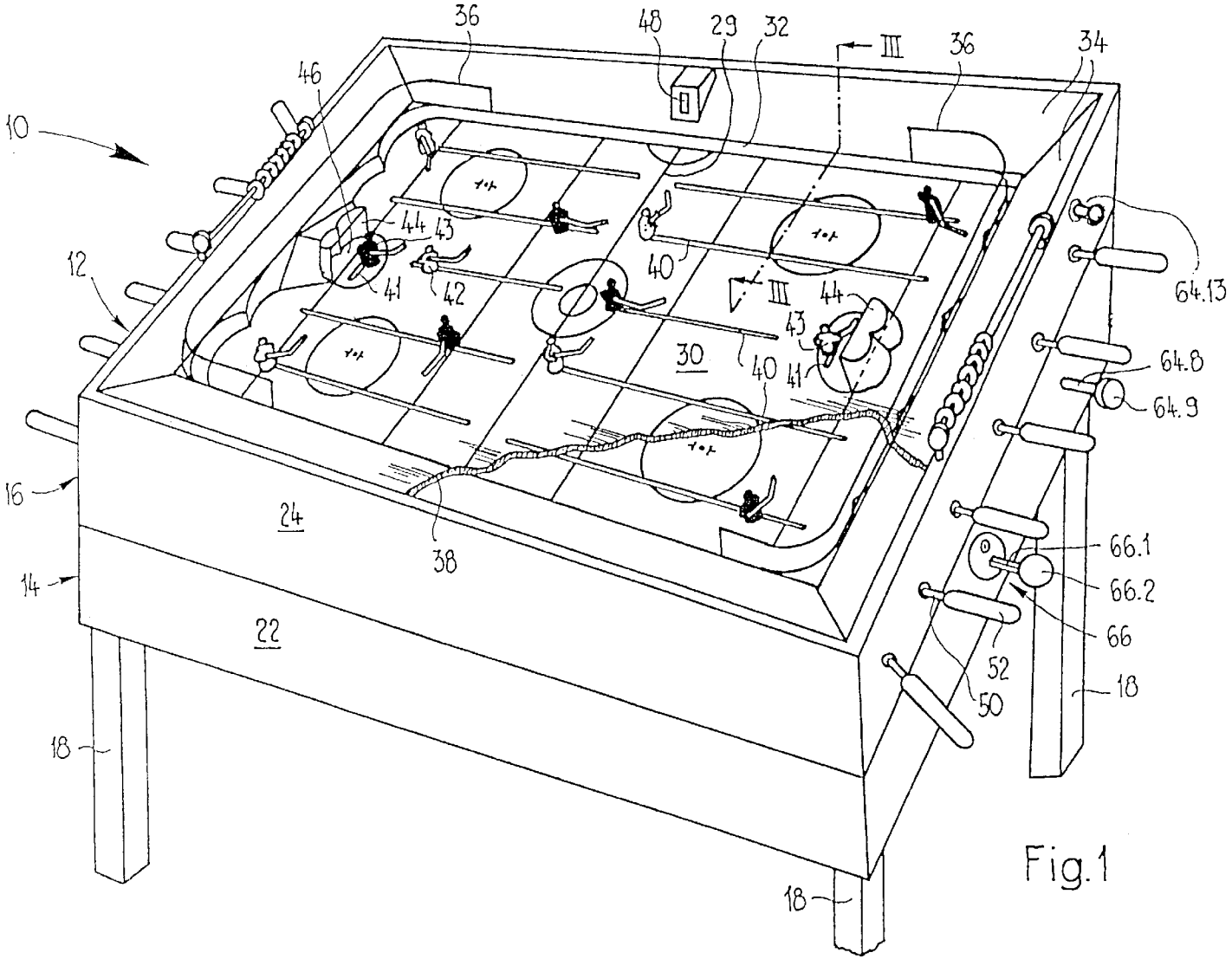
FIG. 1, a perspective view of a table hockey game device of the invention.
Figure 2:
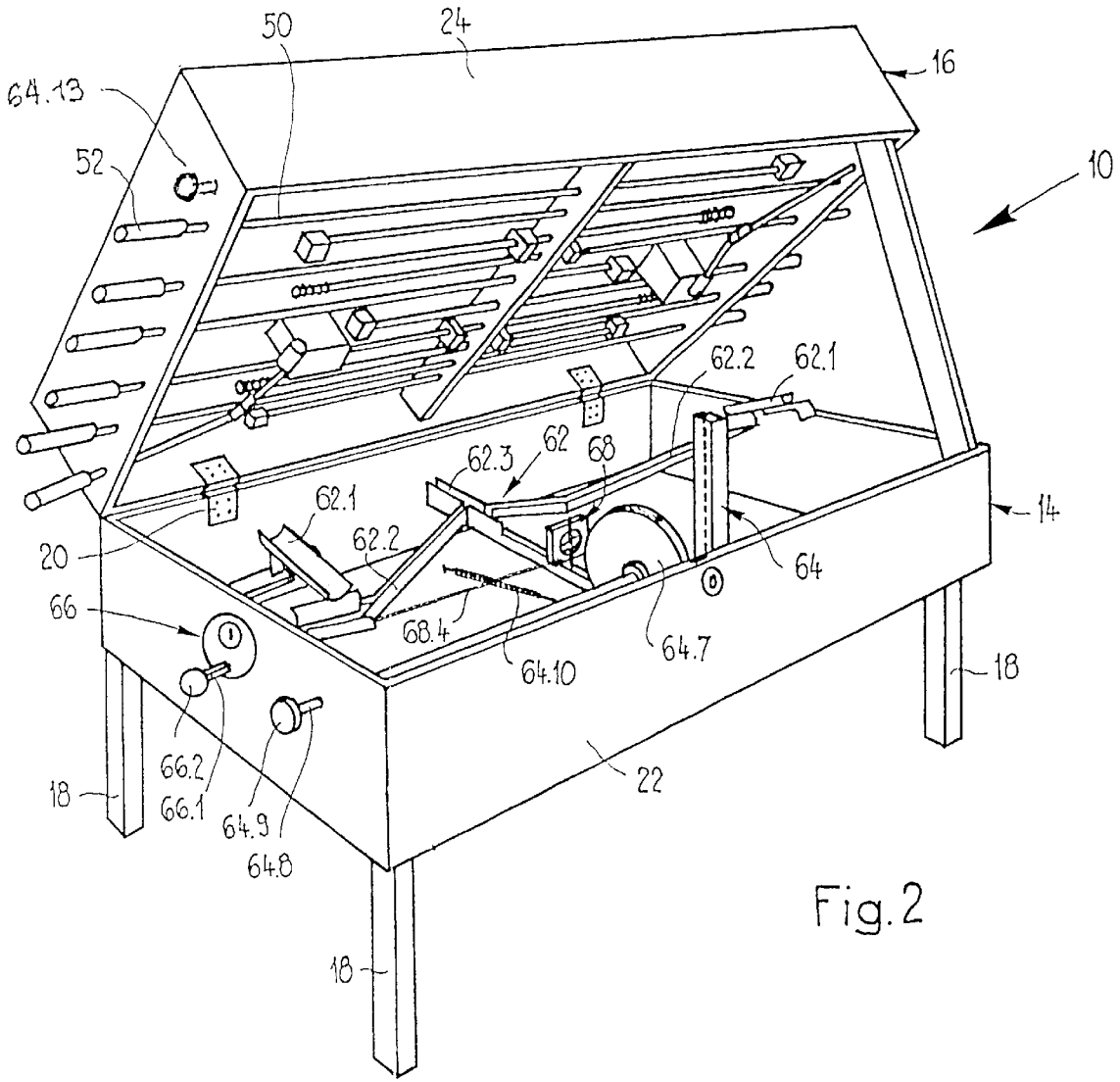
FIG. 2, a perspective view of the table hockey game device represented in FIG. 1 in the opened state, FIG. 3, a vertical section along the center line of the playing field, FIG. 4, a perspective view of a lower portion of the box, FIG. 5, a perspective view of details of the puck transfer device, FIG. 6, a further detail of the puck transfer device in a view from the top and partially in section, and FIG. 7, a lateral view of a coin insertion and time switch device, partially in section.

In accordance with FIG. 1, the novel table hockey game device 10 has a box 12 consisting of a lower box element 14 and an upper box element 16. Four legs 18 have been attached to the lower box element 14, one of which can be adjusted in length in a manner not represented, and by which legs the box 12 is supported on the floor. The two box elements 14, 16 are connected with each other by means of hinges 20 so that, for opening the box 12, the upper box element 16 can be pivoted upward away from the lower box element 14 as represented in FIG. 2. With the box 12 closed, each of the four side walls 22 of the lower box element 14 lies in a vertical plane with the corresponding side walls 24 of the upper box element 16. A side wall of the upper box element 16 is designed in the manner of a door and can be pivoted away along its lower edge, so that access to the interior of the upper box element 16 for maintenance work is easily provided.

Figure 3:
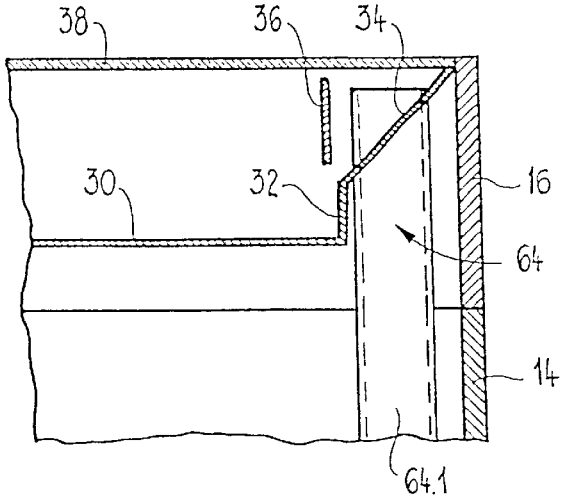

The upper box element 16 contains the playing field 30. It is a rectangle, wherein the ratio of the width to the length of the rectangle lies in the range of 0.3 to 0.82, but preferably is the same as a regulation playing field. A vertical frame, or respectively barrier, 32 extends around the playing field 30. The upper edges of this barrier 32 and the upper edges of the side walls 24 of the upper box element 16 are connected by inclined faces 34, from where a puck, which had accidentally landed there, can slide back on the playing field 30. A transparent plastic strip 36 extends along the short sides of the playing field 30 above the barrier 32 in place of the net, which is customary in hockey stadiums, and is extended in a rounded-off manner past the edges into the end area of the long sides of the playing field 30. A horizontal flat plate 38 which can be either flat or curved and which can be seen parallel to playing field 30 in FIG. 3, is arranged between the side walls 24 and covers the playing field 30.

In addition to the customary circles and lines required for playing like e.g. the center line 29, the playing field 30 has ten slits 40. Guide bodies, not represented, which can be displaced along the slits 40, are received therein. A figure player 42 is fastened on each guide body above the playing field 30, and a player actuation mechanism, which will be described in a later section, below the playing field 30.

A goal installation 44 is fastened on both small sides of the playing field 30, which is represented without a net for the sake of simplicity. A further slit 41 has been cut into the playing field 30 in front of each goal installation 41, which can be straight or curved and essentially extends parallel with the short sides of the playing field 30. Further guide bodies are received in the slits 41, on which further player figure 43, which act as goalies during the game, are fastened above the playing field 30, and further player actuation mechanisms, which will also be described later, below the playing field. Furthermore, the playing field 30 has an opening at each of the two goal installations 44, which constitutes a puck passage 46, through which a puck 1 leaves the playing field 30 when a goal has been scored in a game.

A puck insertion opening 48 in the shape of a vertical slit is arranged outside of the playing field 30 in the area of the center line 29 on the inclined face 34.

As already mentioned, each guide body is fastened on a player actuation mechanism assigned to it by means of an actuating rod 50 which, in accordance with FIG. 2, is arranged in the upper box element 16 below the playing field 30. The actuating rods 50 project through one of the narrow side walls out of the upper box 16 and are provided with grips 52 on the outside. Fastening is provided in such a way that it is possible to displace the respectively associated player figure 42, 43 along their slits 40, 41 by linearly moving the actuating rods 50 in the appropriate direction, i.e. by pulling them out of the upper box element 16 or pushing them into it, and that the player figure 42, 43 are made to rotate by turning the actuating rods 50. The actuating rods 50 of all players 42, 43, which are parts of a first team in white uniforms, project out of the box 12 on the one narrow side, regardless of whether these player figure 42, 43 are posted in the half of the playing field adjoining this narrow side, or in the opposite half. Correspondingly, the actuating rods 50 of all players 42, 43 which are members of the second team in black uniforms, extend out of the box 12 at the other end.

Figure 4:
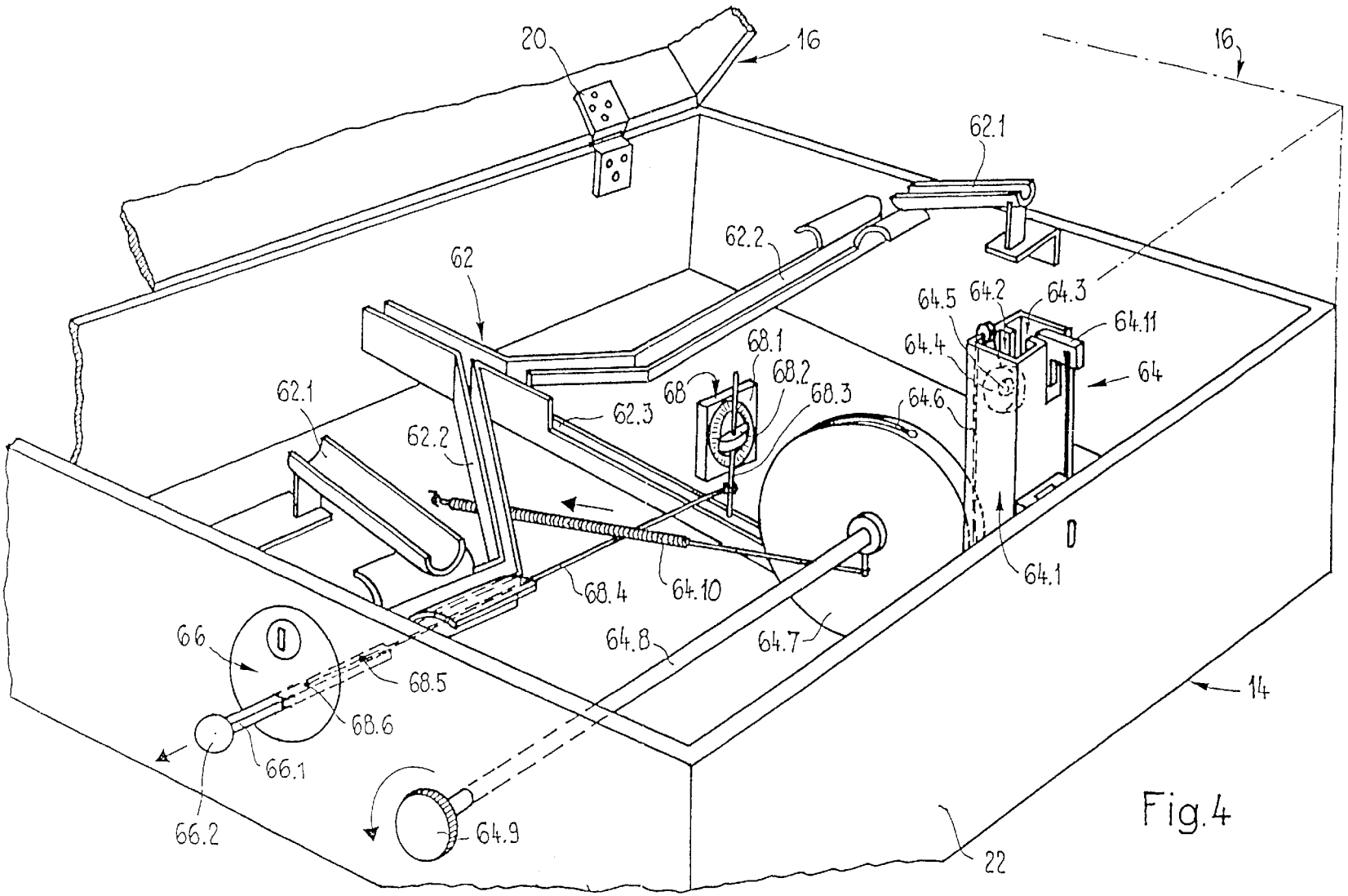

In accordance with FIG. 2 and FIG. 4, the lower box element 14 contains a puck transfer device 60, comprising a conduit system 62 and a puck elevator 64 which, together with the playing field 30, form a closed path for the puck 1, as well as a coin insertion device 66 and a time switch device 68.

As mentioned, the conduit system 62 and the puck elevator 64 are part of the puck transfer device 60. After a goal has been scored, the puck 1 rolls in the conduit system 62 from the puck passage 46 of the playing field 30 in the area of one of the goal installations 44 to the lower end of the puck elevator 64, which subsequently brings it to the level of puck insertion opening 48.

The conduit system 62 has two catch channels 62.1 below the puck passages 46, into which a puck 1 falls when a goal has been scored, and each of which terminate in a partial channel 62.2. In turn, the partial channels 62.2 terminate in a common center channel 62.3, in which the puck 1 gets as far as the puck elevator 64. The catch channels 62.1, the partial channels 62.2 and the center channel 62.3 are inclined slightly downward, viewed in the movement direction of the puck 1, and the cross sections of the partial channels 62.2, as wall as the center channel 62.3, are designed in such a way that the puck 1 rolls in them.

Figure 5:
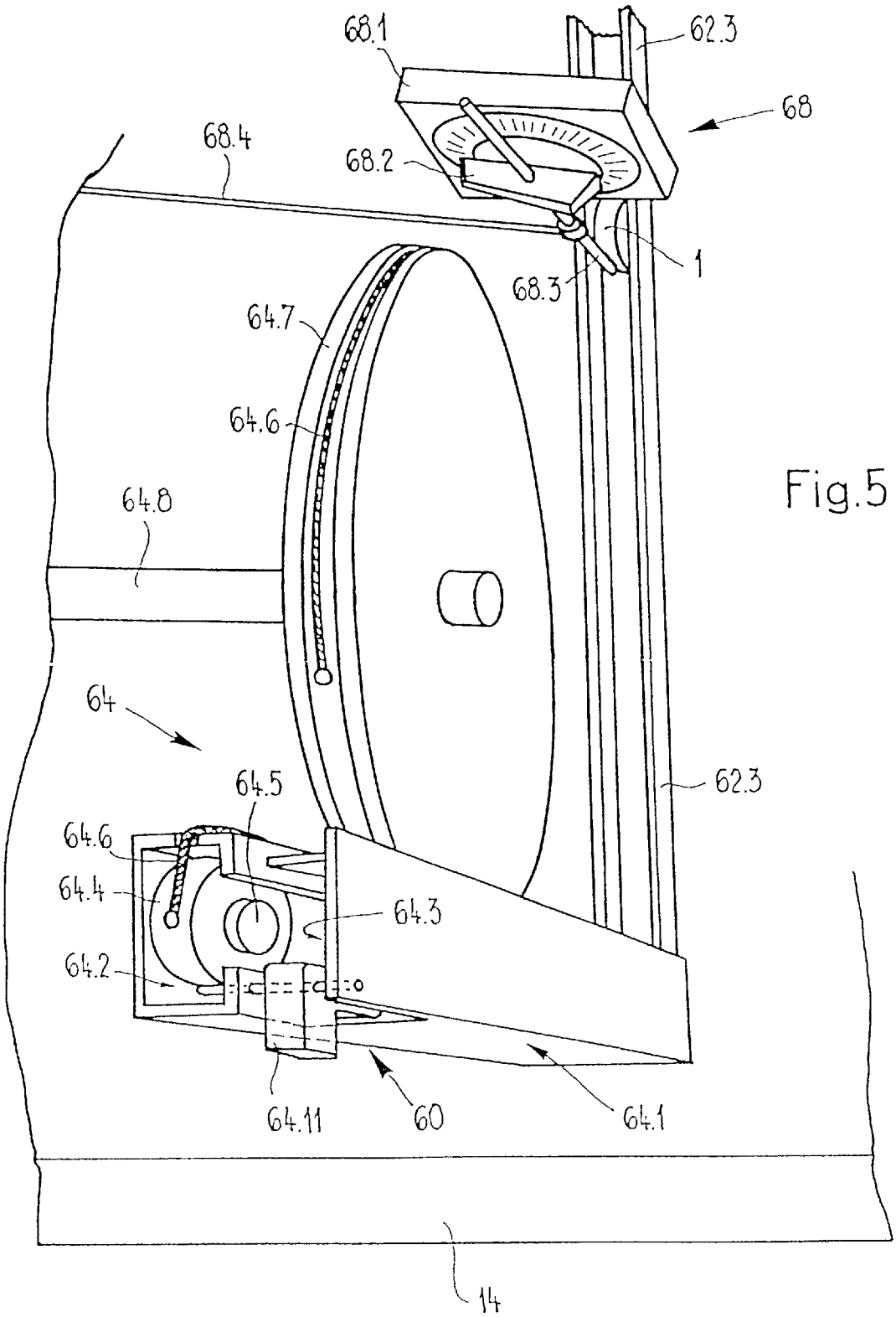

In accordance with FIG. 5, the puck elevator 64 has an elevator shaft 64.1, which is arranged in the box 12 outside of the playing field 30 centered on one of its long sides and extends upward out of the lower box element 14 so that, with the box 12 closed, it projects into the upper box element 16 and terminates there in the area of the puck insertion opening 48. The elevator shaft 64.1 has two adjoining partial shafts 64.2, 64.3. An elevator body 64.4 is arranged in the first partial shaft 64.2, which assumes the function of an elevator platform, so to speak, and can be pushed up and down inside the partial shaft 64.2. The elevator body 64.4 has a laterally arranged magnetic shoulder 64.5 facing the partial shaft 64.3. The second partial shaft 64.3 is intended for receiving pucks 1, which have a magnetic area arranged in their axis and therefore adhere to the magnetic shoulder 64.5 of the elevator body 64.4 as soon as they are arranged opposite it.

The end of a flexible pulling element 64.6, for example a cord, is fastened on the elevator body 64.4. The other end of the flexible pulling element 64.6 runs over a notch of a reversing roller at the side of the first partial shaft 64.2 and is fastened on the periphery of a further roller 64.7. This further roller 64.7 is arranged, fixed against relative rotation, on a shaft 64.8, which projects through the side wall 22 on one of the narrow sides of the lower box element 14, and which is provided with a turning knob 64.9 on its outer end. Moreover, a restoring spring 64.10 is fastened on the roller 64.7, whose other end is fixed on the bottom of the lower box element 14.

In another embodiment, not represented, the further roller has a crown gear, which works together with a toothed rack, whose extension projects laterally out of the lower box element. The vertical movement of the elevator body 64.4 is then performed not by the turning of the shaft 64.8, but by pulling on the extension of the toothed rack.

To prevent oscillations of the flexible pulling element 64.6, a damping device, not represented, is provided which, in the present exemplary embodiment is designed as a spring, whose one end is fastened on the underside of the elevator body 64.4 and the other end on the bottom of the lower box element 14, and which exerts a lesser force than the restoring spring 64.10.

In the normal case, i.e. when no puck 1 is to be pulled upward, the elevator body 64.4 is in its upper end position, acted upon by the force of the restoring spring 64.10. If a puck 1 is to be pulled up, the roller 64.7 is rotated via the shaft 64.8 and against the force of the restoring spring 64.10 in a counterclockwise direction—as viewed in FIG. 4—, so that the pulling element 64.6 is unwound from the roller 64.7, and the elevator body 64.4 is moved downward in the first partial shaft 64.2 until it has reached its lower end position. As soon as this occurs, the puck 1, which is to be pulled up, is attracted by the magnetic shoulder 64.5 of the elevator body 64.4. To convey the puck 1 upward, the shaft 64.8 is released, whereupon the roller 64.7, together with the shaft 64.8 turns back into its original position under the force of the restoring spring 64.10, so that the pulling element 64.6 is again wound on the roller 64.7 and in the process brings the elevator body 64.3 and the puck 1 adhering to it into the upper end position.

Figure 6:
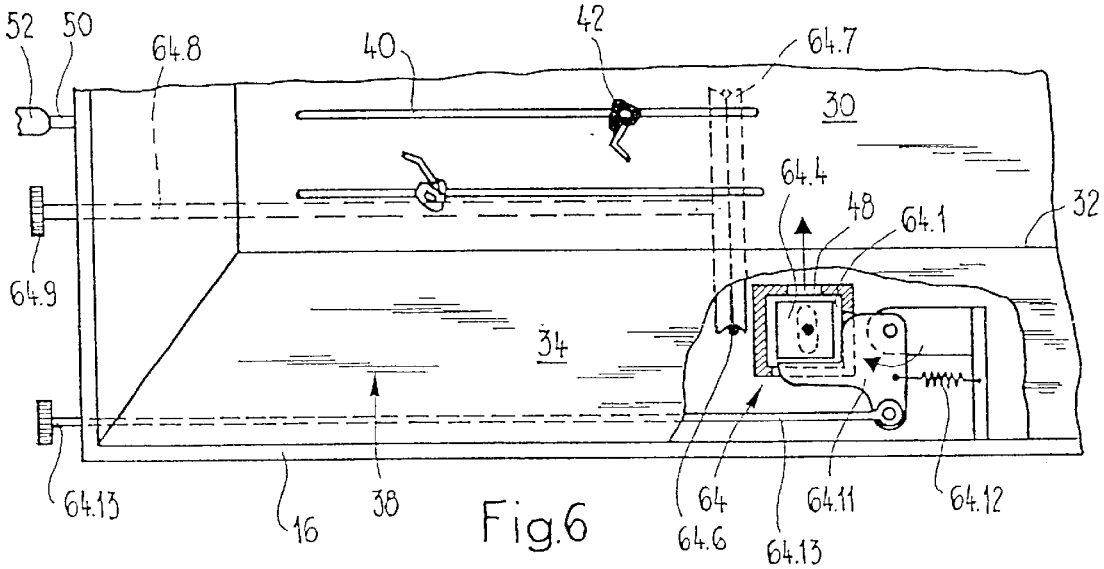

As already mentioned, in accordance with FIG. 5, the puck insertion opening 48 is located next to the upper end of the elevator shaft 64.1, at which level the puck 1 is located, once it has reached its uppermost position in the elevator shaft 64.1. A pusher 64.11 is used to push the puck 1 away from the elevator body 64.4 and to convey it through the puck insertion opening 48 on the playing field 30. FIG. 6 represents a variation of this pusher device 64.11, which is suitable in connection with a construction in which the puck 1 adheres to the elevator body not at the side, but at the bottom. In this case the pusher 64.11, which can be actuated against the force of a pusher restoring spring 64.12 via a pusher rod 64.13 projecting out of the upper box element 16, is provided to convey the puck 1 from its upper position out of the elevator shaft 64.1 through the puck insertion opening 48 on the playing field 30.

Figure 7:
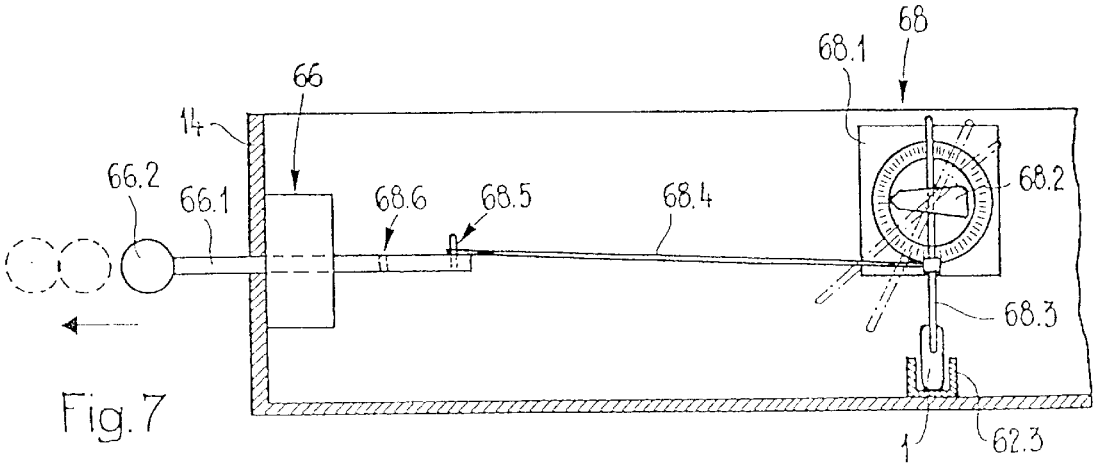

As already mentioned and represented in FIG. 7 in particular, the coin insertion device 66 and the time switch 68 connected with it, are arranged in the lower box element 14 of the table hockey game device 10. These are used for limiting the time of the games and can operate in two different ways. In accordance with the first type of play only one puck 1 is in play, which is available for a defined period of time following the insertion of an appropriate coin. In accordance with the second type of play there are several pucks 1, which are sequentially put into the game, and the game lasts until a goal has been scored with every puck. As will be described in what follows, the time switch device 68 and the coin insertion device 66 are designed and arranged in such a way that it is possible to play alternatively in accordance with both varieties by means of the same table hockey game device 10. It should be pointed out here that within the scope of the present specification coins are understood to be monetary coins or monetary-coin-like tokens or plastic tokens, which need not be round.

The time switch device 68 comprises a conventional time switch device 68.1, on whose winding knob 68.2 a rod is fastened, which is used as a blocking body 68.3 in order to block the center channel 62.3 to the passage of pucks 1. One end of a flexible connecting element 68.4, for example a cable, is fastened on the blocking body 68.3. Its other end is connected at 68.5 with a profiled pull element 66.1 of the coin insertion device 66, which can be actuated by means of a handle 66.2 against the force of a restoring spring, not represented. The profiled pull element 66.1 cannot be actuated until a coin has been inserted.

If play is performed in accordance with the first type of play, i.e. with only one puck 1, the game takes place as follows: by inserting the coin, it is possible to pull out the profiled pull element 66.1 of the coin insertion device 66. In the process, the coin falls into a cash drawer, not represented, and the blocking body 68.3 is simultaneously turned out of its blocking position in a clockwise direction—as seen in FIG. 4—. The puck 1, not represented in FIG. 4, which up to now had been stopped in the center channel 62.3 by the blocking body 68.3, now rolls to the lower end of the elevator shaft 64.1, where it is attracted, as already described, by the magnetic shoulder 64.5 of the elevator body 64.4. Now the roller 64.7 is rotated by actuating the shaft 64.8, and in this way the elevator body 64.4, together with the puck 1, is brought from the lower end position into the upper end position. Thereafter the pusher 64.11 is actuated, and the puck 1 reaches the playing field 30 through the puck insertion opening 48. Actual play now commences, and following each scored goal, the puck 1 returns to the playing field 30 via the puck passage 46, the catch channel 62.1, the appropriate side channel 62.2, the center channel 62.3, the puck elevator 64 and the puck insertion opening 48. When the game time is up, the blocking body 68.3 is in the blocking position again. It is only possible to play until the next goal is scored and the puck 1 disappears from the playing field 30 through the puck passage 46. The game is then over, because the blocking body 68.3 prevents the puck 1 from reaching the puck elevator 64. As with an actual hockey game, play is limited by the allotted time, and not by the number of goals scored wherein, however, there is no possibility for time-outs without additional devices on the time switch device.

If it is intended to play in accordance with the second type of play, i.e. with several pucks 1, the connecting cable 68.4 is not fastened at 68.5, as described above, but at 68.6. Prior to the start of the game, the pucks 1 are located one behind the other in the center channel 62.3 above the blocking body 68.3. As in the game with only a single puck 1, only one coin is inserted and the connecting cable 68.4 is actuated thereafter for winding the time switch device 68.1 and in the process to turn the blocking body 68.3 out of its blocking position. However, because of the different fastening location of the connecting cable 68.4, the time switch device 68.1 is wound for only a very short time, which is just sufficient to let all pucks 1 roll through the lower end of the center channel 62.3 as far as the elevator shaft 64.1 before the blocking body 68.3 returns into its blocking position. A first puck 1 is not brought to the playing field 30 in the same way as described above, where it remains until the first goal is scored. Then the first puck 1 reaches the center channel 62.3 in the customary manner, where it is held back by the blocking body 68.3. The game continues in that after each scored goal the respectively next puck 1 is conveyed to the playing field 30, and it is terminated when a goal has been scored by means of every available puck 1. Thus, with this type of play the length of the play is not limited by time, but by the maximum number of goals which can be scored. In contrast to the first described type of play it is also possible here to play with several pucks simultaneously for a change.

The table hockey game device 10 can be easily reset if a change is to be made from one to the other type of play.

It is expressly pointed out that the above described table hockey game device represents only one of a multitude of possible embodiment variations which can be realized within the scope of the claims. Further variations are mentioned in the following, not complete, recitation.

A purely mechanical table hockey game device can for example have a puck path which is not closed and/or a puck dispensing opening within the playing field. On the other hand, a table hockey game device with a closed puck path and a puck dispensing opening outside of the playing field can be partially electronically controlled, or respectively electromechanically operated.

In place of legs, the table hockey game device can have a pedestal, or can be arranged on a wall console.

Individual player figures can also be displaced in slits parallel in respect to the narrow sides of the playing field, instead of only in slits parallel with the long sides of the playing field and, as described, a displacement behind the goal installations in particular can be provided.

The puck elevator need not be arranged inside the box, instead it can constitute a lateral shoulder on the box and it can be used as an inclined conveyor instead of the above described vertical conveyor.

The mechanism by means of which the puck is conveyed out of the puck elevator to the playing field can be constituted by a plunger arranged on the long side of the box and which is to be operated by means of a press switch.

Instead of paying for the game by the insertion of coins or tokens, it is possible to provide a cancellation device, which lowers the value of a subscription-like voucher each time. It is also conceivable to switch several devices together to form a common pay station. Finally, it would also be possible to produce table hockey game devices without mechanisms for payment of the game fees for use in competitions.

With the device described in detail above, all operating levers and buttons are arranged on the two narrow sides of the playing field in order to be operated in this way by two players. For competition devices, the levers for the actuation of the player figures only are preferably arranged on the narrow sides, while all other operating levers and buttons are arranged on the long sides in order to be actuated there by an umpire. With competition devices having a time switch device, play should either take place in accordance with the second system, i.e. with several pucks, or an additional time-out mechanism needs to be provided, which stops the time switch device during the time-out. Such a time-out mechanism would have to have a blocking device for temporarily stopping the blocking member of the time switch device from returning into its blocking position. This mechanism, too, should preferably be operable from a long side.

Although violations of the rules, or respectively fouls in the actual sense, i.e. among the player figures, cannot occur, it could be desirable in competition games to punish a player by immobilizing one of his player figures. For structural reasons the player figure, whose actuating mechanism is arranged, opposite the actuating mechanism of the goalie, directly on the long side of the playing field, is best suited for this. For immobilizing the player figure it is possible for the umpire to apply, from the long side of the playing field, or respectively the box, a sort of a brake shoe to the appropriate actuating rod of the player figure to be immobilized.

As is customary during hockey games, it is possible to use the barriers bordering the playing field for advertising spots.

What is claimed is:

1. A table hockey game apparatus having a puck transfer device bringing a puck on to a horizontal playing field through a puck insertion opening situated in an area of a center line of the playing field from puck passages arranged in an area of goal installations, wherein the puck transfer device is an entirely mechanical, and an entirely mechanically controlled manually operable device.

2. The table hockey game apparatus according to claim 1, wherein the puck transfer device has a channel system having a partial channel emanating from each of the goal installation, wherein each said partial channel terminates in a common main channel, and wherein each said channel and the main channel are downwardly inclined in a transfer direction.

3. The table hockey game apparatus according to claim 2, wherein the puck transfer device has a puck elevator, which has an elevator shaft, in which an elevator body can be displaced, wherein the elevator shaft starts at an end of the channel system and terminates at the puck insertion opening.

4. The table hockey game apparatus according to claim 3, wherein the elevator body has a magnetic shoulder, to which a magnetizable puck adheres.

5. The table hockey game apparatus according to claim 3, wherein an end of a flexible pulling element is fastened in the elevator body, whose other end is fastened on a roller, wherein the roller is either fastened in a manner fixed against relative rotation on a shaft, which has an end projecting out of an apparatus box, or a crown gear, which cooperates with a toothed rack having an extension projecting out of the apparatus box.

6. The table hockey game apparatus according to claim 1, wherein the puck transfer device can be temporarily unblocked by means of a blocking device of a manually operable time switch device.

7. The table hockey game apparatus according to claim 6, wherein the time switch device includes a time switch mechanism, on which the blocking device for the puck transfer device is fastened.

8. The table hockey game apparatus according to claim 6, wherein the time switch device can be wound by means of a releasable profiled pull element projecting out of an apparatus box.

9. The table hockey game apparatus according to claim 8, having a coin, or respectively token, insertion device, which releases the releasable profiled pull element when a coin is inserted.

10. The table hockey game apparatus according to claim 1, wherein the playing field rectangle has a ratio of the narrow side to the long side that conforms at least approximately to regulation field and lies in the range between 0.3 and 0.82.

11. A table hockey game apparatus having a puck transfer device bringing a puck on to a playing field through puck insertion openings of the playing field from puck passages arranged in an area of goal installations, wherein the playing field
- essentially forms a rectangle with a center line,
- is horizontal,
- is covered above the puck insertion opening by a transparent plate,
- constitutes, together with the puck transfer device and the puck insertion opening,.a path, closed in itself, for the puck, the puck transfer device including the puck insertion opening are located outside of the playing field, and the puck insertion opening is situated in the area of the center line.

12. The table hockey game apparatus according to claim 11, wherein the puck transfer device has a channel system having a partial channel emanating from each of the goal installation, wherein each said partial channel terminates in a common main channel, and wherein each said channel and the main channel are downwardly inclined in a transfer direction.

13. The table hockey game apparatus according to claim 12, wherein the puck transfer device has a puck elevator, which has an elevator shaft, in which an elevator body can be displaced, wherein the elevator shaft starts at an end of the channel system and terminates at the puck insertion opening.

14. The table hockey game apparatus according to claim 12, wherein the elevator body has a magnetic shoulder, to which a magnetizable puck adheres.

15. A table hockey game device apparatus having a puck transfer device bringing a puck through puck insertion openings from puck passages arranged in an area of goal installations on a playing field, wherein the playing field
- essentially forms a rectangle with a center line, is horizontal, is covered above the puck insertion opening by a transparent plate, and constitutes, together with the puck transfer device and the puck insertion opening, a path, closed in itself, for the puck, the puck transfer device is an entirely mechanical, and entirely mechanically controlled manually operable device, is located outside the playing field, the puck insertion opening is located on a side or above an outside of the playing field and in an area of the center line.

16. A table hockey game apparatus having a puck transfer device bringing a puck on to a horizontal playing field through a puck insertion opening situated in an area of a center line of the playing field from puck passages arranged in an area of goal installations, wherein the puck transfer device is an entirely mechanical, and an entirely mechanically controlled manually operable device;

wherein the puck transfer device has a puck elevator, which has an elevator shaft, in which an elevator body can be displaced, wherein the elevator shaft starts at an end of the channel system and terminates at the puck insertion opening; and the elevator body has a magnetic shoulder, to which a magnetizable puck adheres.

17. The table hockey game apparatus according to claim 16, wherein an end of a flexible pulling element is fastened in the elevator body, whose other end is fastened on a roller, wherein the roller is either fastened in a manner fixed against relative rotation on a shaft, which has an end projecting out of an apparatus box, or a crown gear, which cooperates with a toothed rack having an extension projecting out of the apparatus box.

18. The table hockey game apparatus according to claim 16, wherein the puck transfer device can be temporarily unblocked by means of a blocking device of a manually operable time switch device.

19. The table hockey game apparatus according to claim 18, wherein the time switch device includes a time switch mechanism, on which the blocking device for the puck transfer device is fastened.

20. The table hockey game apparatus according to claim 16, wherein the time switch device can be wound by means of a releasable profiled pull element projecting out of an apparatus box.

21. The table hockey game apparatus according to claim 20, having a coin, or respectively token, insertion device, which releases the releasable profiled pull element when a coin is inserted.

22. The table hockey game apparatus according to claim 16, wherein the playing field rectangle has a ratio of the narrow side to the long side that conforms at least approximately to regulation field and lies in the range between 0.3 and 0.82.

* * * * *